US010267317B2

(12) United States Patent
Lopes et al.

(10) Patent No.: US 10,267,317 B2
(45) Date of Patent: Apr. 23, 2019

(54) TECHNIQUE FOR PREVENTING AIR LOCK THROUGH STUTTERED STARTING AND AIR RELEASE SLIT FOR PUMPS

(71) Applicant: Flow Control LLC, Gloucester, MA (US)

(72) Inventors: Jeffrey Lopes, Gloucester, MA (US); Jesus Estrada, Gloucester, MA (US); Kevin Teed, Lawrence, MA (US)

(73) Assignee: Flow Control LLC., Beverly, MA (US)

( * ) Notice: Subject to any disclaimer, the term of this patent is extended or adjusted under 35 U.S.C. 154(b) by 245 days.

(21) Appl. No.: 13/917,970

(22) Filed: Jun. 14, 2013

(65) Prior Publication Data

US 2013/0336763 A1 Dec. 19, 2013

Related U.S. Application Data

(60) Provisional application No. 61/659,631, filed on Jun. 14, 2012.

(51) Int. Cl.

| | |
|---|---|
| ***F04D 15/00*** | (2006.01) |
| ***F04D 9/00*** | (2006.01) |
| ***F04D 13/08*** | (2006.01) |

(52) U.S. Cl.

CPC ..... *F04D 15/0094* (2013.01); *F04D 9/003* (2013.01); *F04D 9/006* (2013.01); *F04D 13/086* (2013.01); *F04D 15/0066* (2013.01)

(58) Field of Classification Search

CPC . F04D 9/00; F04D 9/001; F04D 9/002; F04D 9/003; F04D 9/007; F04D 1/00;

(Continued)

(56) References Cited

U.S. PATENT DOCUMENTS 2,643,615 A * 6/1953 Murphy ..... F04D 29/044 415/121.2
2,910,003 A * 10/1959 Kaatz ..... F04D 15/0218 200/83 A (Continued)

FOREIGN PATENT DOCUMENTS

| | | |
|---|---|---|
| CA | 1076885 | 5/1980 |
| CN | 2911253 | 6/2007 |

(Continued)

OTHER PUBLICATIONS

Homer, "Report on new Pumping a systems software on Pumping Instrumentation and Control Skids", Apr. 19, 2001, Technical report.*

(Continued)

*Primary Examiner* — Patrick Hamo
*Assistant Examiner* — Joseph S. Herrmann
(74) *Attorney, Agent, or Firm* — Ware, Fressola, Maguire & Barber LLP

(57) ABSTRACT

Apparatus, including a pumping system, is provided featuring a pump and a control circuit. The pump has an impeller housing configured with a slit at the top for trapped air to leave the impeller housing once the pump has been submerged. The control circuit is configured to cycle the pump on and off for a predetermined number of cycles so that the trapped air will float to the top and be expelled out the slit when the pump is cycled off. The control circuit is configured to leave the pump on after the predetermined number of cycles.

14 Claims, 5 Drawing Sheets

Pump having anti-air lock slit

Shutting off the pump allows the release of trapped air

(58) Field of Classification Search
CPC ..... F04D 15/00; F04D 15/0128; F04D 17/00; F04D 9/006; F04D 15/0094; F04D 15/0066; F04D 13/064
USPC ..... 417/423.3, 435, 12, 211.5, 306, 366
See application file for complete search history.

(56) References Cited

U.S. PATENT DOCUMENTS 3,021,788 A * 2/1962 Kaatz ..... F04D 15/0218 417/18
3,227,089 A * 1/1966 Haarhuis ..... F04D 1/066 415/144
3,291,058 A * 12/1966 McFarlin ..... F04D 9/006 415/1
3,325,657 A * 6/1967 Corey ..... H03K 17/292 290/38 R
3,406,295 A * 10/1968 Corey ..... H03K 17/292 307/132 E
3,575,521 A * 4/1971 Porter ..... F04D 9/00 137/197
3,867,071 A 2/1975 Hartley
4,087,204 A * 5/1978 Niedermeyer ..... F04B 49/025 417/17
4,087,994 A 5/1978 Goodlaxson
4,592,700 A * 6/1986 Toguchi ..... F04D 29/2244 415/225
4,787,816 A * 11/1988 Jensen ..... F04D 9/003 415/169.1
4,913,620 A 4/1990 Kusiak et al.
4,981,413 A * 1/1991 Elonen et al. ..... 415/115
5,209,641 A * 5/1993 Hoglund ..... D21D 5/26 415/169.1
5,324,170 A * 6/1994 Anastos et al. ..... 417/12
5,400,732 A * 3/1995 Berge ..... B63B 25/082 114/74 R
5,545,012 A * 8/1996 Anastos ..... F04B 49/02 318/484
5,577,890 A * 11/1996 Nielsen ..... F04B 49/065 318/729
5,599,171 A * 2/1997 Horwitz ..... F04C 5/00 415/143
5,632,220 A 5/1997 Vento
5,647,329 A 7/1997 Bucci et al.
5,769,603 A * 6/1998 Fujiwara ..... F04D 7/04 415/169.1
5,856,783 A * 1/1999 Gibb ..... B67D 7/766 324/660
6,203,282 B1 * 3/2001 Morin ..... F04D 15/0236 417/423.3
6,206,632 B1 * 3/2001 Gallus ..... A23L 3/022 29/888.021
6,254,353 B1 * 7/2001 Polo ..... F04D 15/0077 318/280
6,350,105 B1 2/2002 Kobayashi et al.
6,390,780 B1 * 5/2002 Batchelder et al. ..... 417/36
6,457,940 B1 10/2002 Lehman
6,481,973 B1 * 11/2002 Struthers ..... F04D 7/045 417/36
6,676,382 B2 * 1/2004 Leighton ..... F04D 29/2222 417/12
6,684,946 B2 * 2/2004 Gay ..... E21B 43/128 166/105
7,131,330 B2 * 11/2006 Gurega ..... F04D 15/0218 417/40
7,232,288 B2 * 6/2007 Tibban ..... 415/169.1
7,798,215 B2 * 9/2010 Leuthen ..... E21B 43/128 166/105
8,133,034 B2 3/2012 Mehlhorn et al.
8,602,743 B2 * 12/2013 Stiles, Jr. ..... F04B 49/10 318/400.21
8,760,302 B1 * 6/2014 MacDonald ..... G01F 25/0061 340/602
9,404,500 B2 * 8/2016 Stiles, Jr. ..... F04D 15/0066
2003/0065425 A1 4/2003 Goodwin et al.
2005/0226731 A1 * 10/2005 Mehlhorn ..... F04D 15/0236 417/44.11
2008/0226467 A1 9/2008 Vento
2008/0288115 A1 * 11/2008 Rusnak ..... F04D 15/0066 700/282
2009/0038696 A1 * 2/2009 Levin ..... F04B 49/002 137/565.11
2010/0028166 A1 2/2010 Collins et al.
2010/0068073 A1 * 3/2010 Branecky ..... F04D 27/004 417/53
2010/0080714 A1 * 4/2010 Mehlhorn ..... F04B 51/00 417/44.11
2010/0319116 A1 12/2010 Schmidt et al.
2011/0002792 A1 * 1/2011 Bartos ..... F04D 15/00 417/44.1
2012/0125624 A1 5/2012 Dyer
2013/0336763 A1 * 12/2013 Lopes ..... F04D 15/0094 415/51

FOREIGN PATENT DOCUMENTS

CN 200943584 9/2007
CN 200964943 10/2007
DE 29522235 1/2001
EP 2320087 5/2011
EP 2320087 A1 * 5/2011 ..... F04D 7/04
JP 61164097 A 7/1986
JP 03160195 7/1991
JP 60741483 3/1994

OTHER PUBLICATIONS

200943584CN English Language Abstract 1 page.
60741483JP English Language Abstract 1 page.
03160195JP English Language Abstract 1 page.
CN2911253 English Language Abstract (1 page).
CN200964943 English Language Abstract (1 page).
English language abstract and translation of JPS61164097A.

* cited by examiner

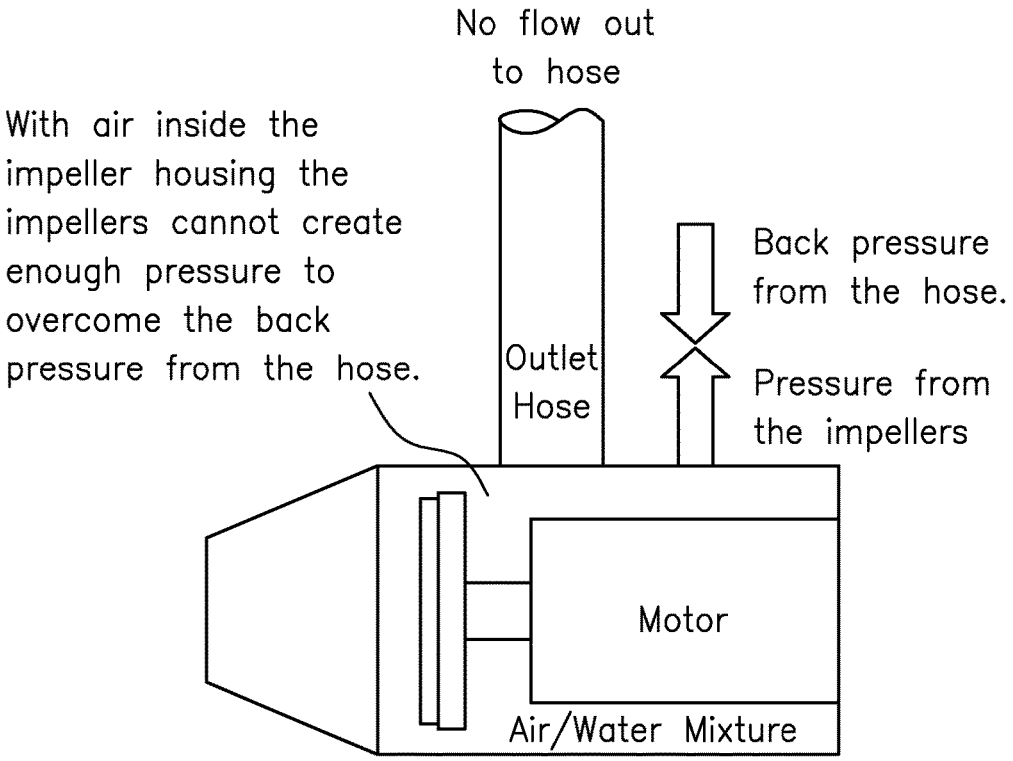
*FIG. 1*: Air locked pump
(PRIOR ART)

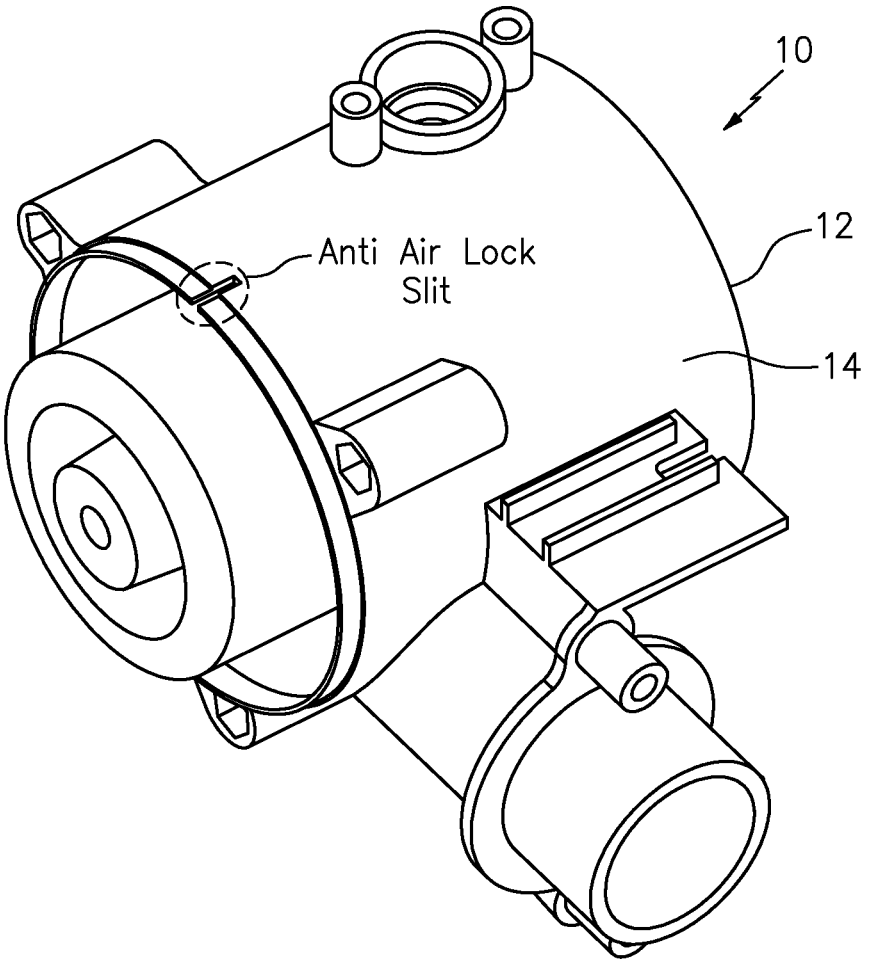
*FIG. 2*: Pump having anti–air lock slit

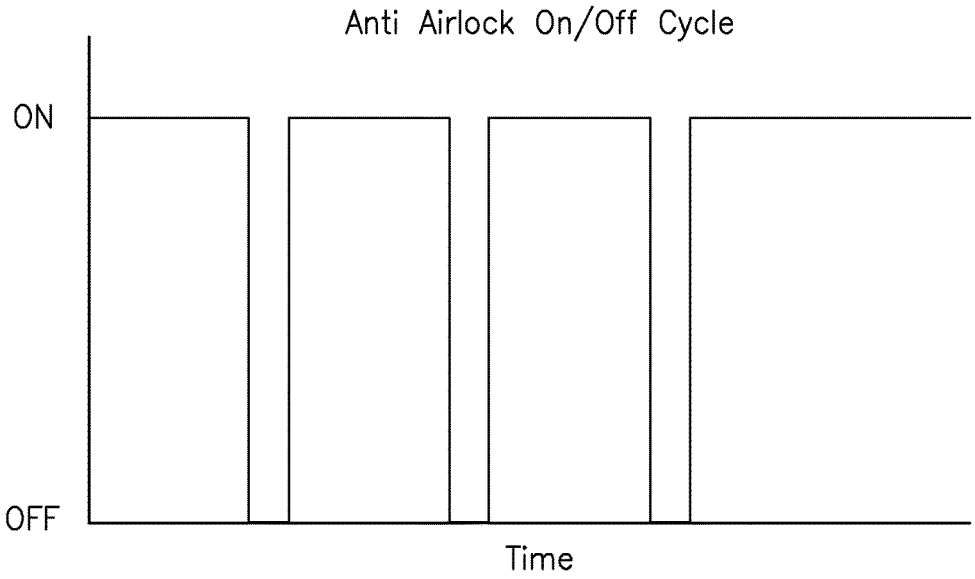
*FIG. 3*: Graph of anti air–lock On/Off startup cycle
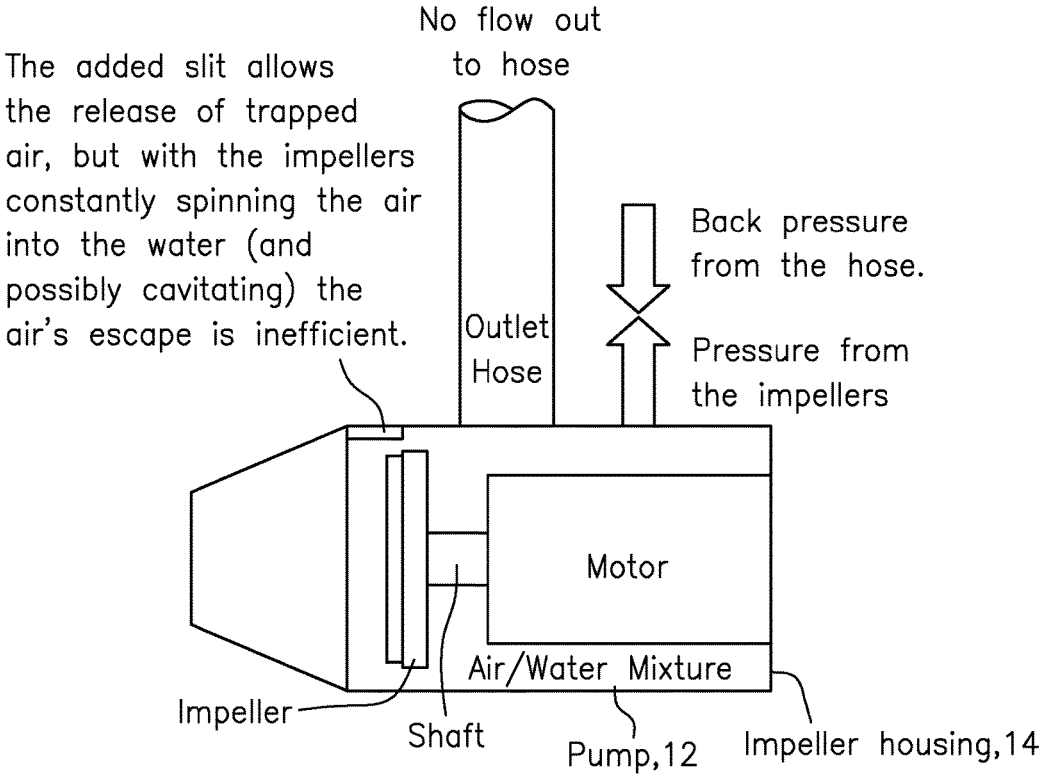
*FIG. 4*: Air locked pump with added slit.

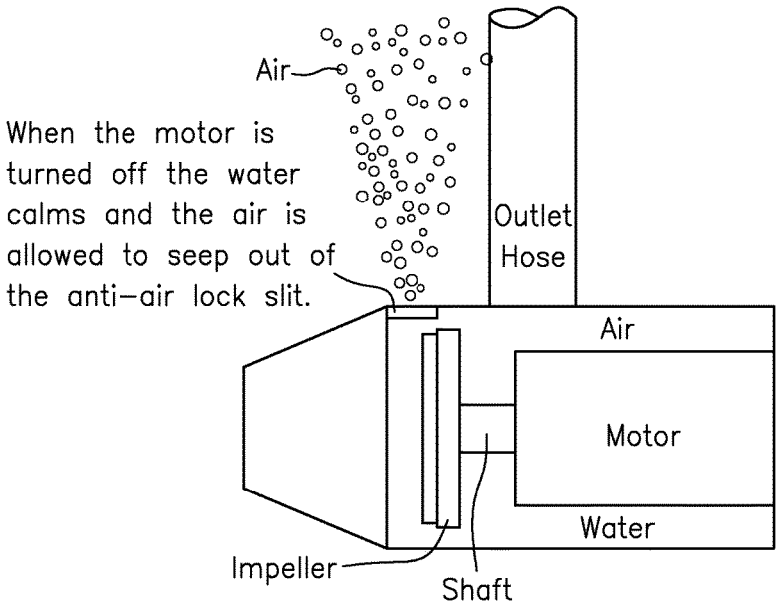
*FIG. 5*: Shutting off the pump allows the release of trapped air
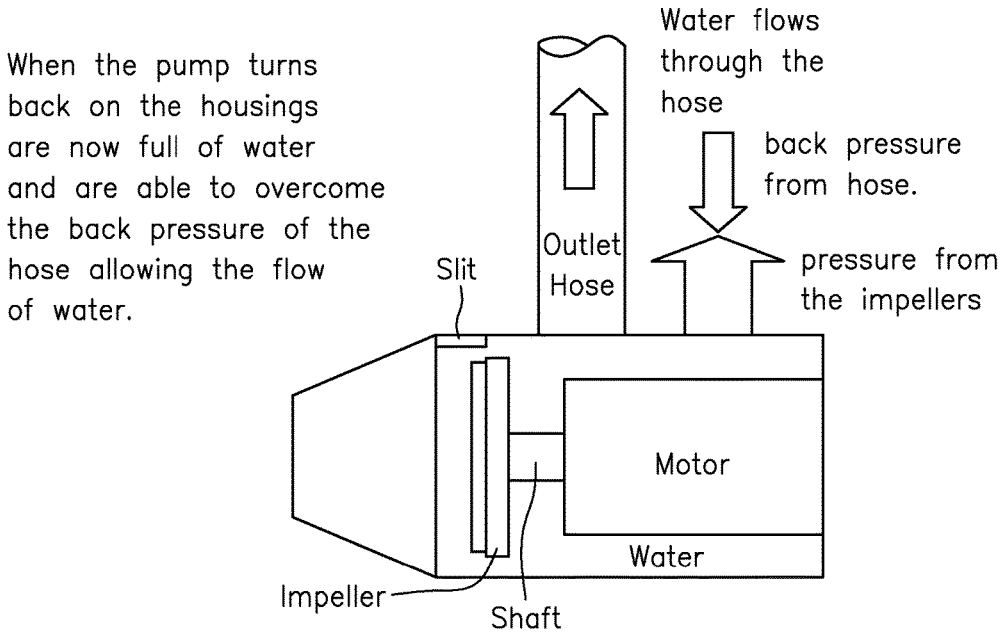
*FIG. 6*: After releasing the air, the pump operates proper

TECHNIQUE FOR PREVENTING AIR LOCK THROUGH STUTTERED STARTING AND AIR RELEASE SLIT FOR PUMPS

CROSS-REFERENCE TO RELATED APPLICATION

This application claims benefit to provisional patent application Ser. No. 61/659,631, filed 14 Jun. 2012, which is hereby incorporated by reference in its entirety.

BACKGROUND OF THE INVENTION

1. Field of the Invention

This invention relates to a pump; and more particularly, relates to a centrifugal pump.

2. Description of Related Art

It is known in the art that if, e.g., a centrifugal pump, is turned on prior to being submerged air can become trapped inside of the housings containing the impellers causing them to pump a gas/liquid mixture instead of the pure liquid mixture they were designed to pump. When this occurs the pump tends to fail to pump water and the air must be expelled or pushed out of the system before the pump can operate as intended. When the pump fails, this situation is known as air lock.

FIG. 1 shows an air locked pump that is known in the art having a motor and an impeller for pumping an air/water mixture. With air inside the impeller housing, the impellers cannot create enough pressure to overcome the back pressure from the outlet hose. As shown, the pressure from the impellers is overcome by the back pressure from the outlet hose, so there is no flow out the outlet hose.

There are known devices whose purpose and intention is to prevent such air lock in, e.g., centrifugal pumps.

By way of example, U.S. Pat. No. 5,545,012, entitled, "Soft Star Pump Control System" discloses a technique, having a system that detects the presence of air lock by measuring the current through the pump motor at any given time. Should the pump detect air lock it uses a switching circuit to the lower the motor voltage and slowly ramp it up from a low value to its full value. However, the system in U.S. Pat. No. 5,545,012 does not always clear the air lock and is more complex than the system proposed in this document. The system also relies on the amount of current going through the motor which can vary greatly depending on the degree of air lock that a centrifugal pump is experiencing or the amount of charge left on a battery powering the system.

U.S. Pat. No. 4,087,994 entitled, "Centrifugal pump with means for precluding airlock" discloses another technique, having a pump with an impeller that contains finger-like protrusions designed to mix the trapped air with the water in the pump so it can be centrifuged out with the water.

U.S. Pat. No. 4,913,620, entitled "Centrifugal water pump," discloses yet another technique, which consists of a pump whose impeller housing chamber has two walls. One of these walls has a radius close to the size of the impeller used in the pump and the other has a larger radius. There are also two terminal walls which direct the water flow to the outlet and break up any air and fills in any space where it could collect.

However, the techniques in U.S. Pat. Nos. 4,087,994 and 4,913,620 are both unnecessarily complex and because of this are cost prohibitive in many situations.

In view of this there is a need for a new, better and more cost effective way to prevent air lock, e.g., in centrifugal pumps.

SUMMARY OF THE INVENTION

According to some embodiments, the present invention may take the form of apparatus featuring a pump and a control circuit. The pump may include an impeller housing configured with a slit at the top for trapped air to leave the impeller housing once the pump has been submerged. The control circuit may be configured to cycle the pump on and off for a predetermined number of cycles so that the trapped air will float to the top and be expelled out the slit when the pump is cycled off.

According to some embodiments, the present invention may include one or more of the following features:

The control circuit may be configured to leave the pump on after the predetermined number of cycles.

The control circuit may be configured to provide signaling to cycle the pump on and off for the predetermined number of cycles so that the trapped air will float to the top and be expelled out the slit when the pump is cycled off.

The apparatus may be configured with a relay arranged between the pump and the control circuit, the relay configured to respond to the signaling provided from the control circuit and provides relay signaling to cycle the pump on and off for a predetermined number of cycles so that the trapped air will float to the top and be expelled out the slit when the pump is cycled off.

The apparatus may be configured as a pumping system having a combination of the pump and the control circuit.

The pump is configured to contain the control circuit, so as to have the control circuit arranged therein.

The pump is configured with a motor coupled to an impeller via a shaft.

The pump is configured as a centrifugal pump.

The Basic Operation

In operation, a so-called stutter start anti-air lock system may consist of two different mechanisms through which air lock in a pump is overcome. First, there is a small slit, hole or orifice which has been cut into the highest point of the impeller housing that allows air trapped inside the unit to escape from inside the impeller housing to outside the impeller housing. Secondly, there is a stuttered starting mechanism which cycles the pump on and off for a predetermined duration until the air lock has been cleared from inside the impeller housing.

By adding this anti air-lock slit, a place is provided for the trapped air to leave the impeller housing once the pump has been submerged. Even with the addition of the slit to the impeller housing, the pump can still become air locked. For example, even with the impeller constantly spinning the air does not necessarily seep out of the added slit and may remain inside the impeller housings. This is where the ON/OFF cycle provided by the control circuit may be implemented. By turning the pump off, the air will float to the top of the pump's impeller housing or internal chamber and be expelled out of the slit.

It is during these so-called "off" times that the air is expelled through the top of impeller housing and the pump fills with liquid. When the motors return to the "on" state, it will be filled with liquid and able to function as intended.

One advantage of the present invention is that it provides a new, better and more cost effective way to prevent air lock, e.g., in centrifugal pumps.

These and other features, aspects, and advantages of embodiments of the invention will become apparent with reference to the following description in conjunction with the accompanying drawing. It is to be understood, however, that the drawing is designed solely for the purposes of illustration and not as a definition of the limits of the invention.

BRIEF DESCRIPTION OF THE DRAWING

The drawing, which is not necessarily to scale, include the following Figures:

FIG. 1 shows a diagram of a known pump in the art that is air locked pump.

FIG. 2 is an illustration of apparatus, including a pumping system having a pump with an anti-air lock slit configured therein, according to some embodiments of the present invention.

FIG. 3 is a diagram showing an anti air-lock On/Off start-up cycle for the apparatus shown in FIG. 2 each time it is started, according to some embodiments of the present invention.

FIG. 4 is a diagram of a pump before the implementation of an anti air-lock on/off start-up cycle, according to some embodiments of the present invention.

FIG. 5 is a diagram of a pump when it is off during the implementation of an anti air-lock on/off start-up cycle, according to some embodiments of the present invention.

FIG. 6 is a diagram of a pump when it is on after the implementation of an anti air-lock on/off start-up cycle, according to some embodiments of the present invention.

Figure 7:
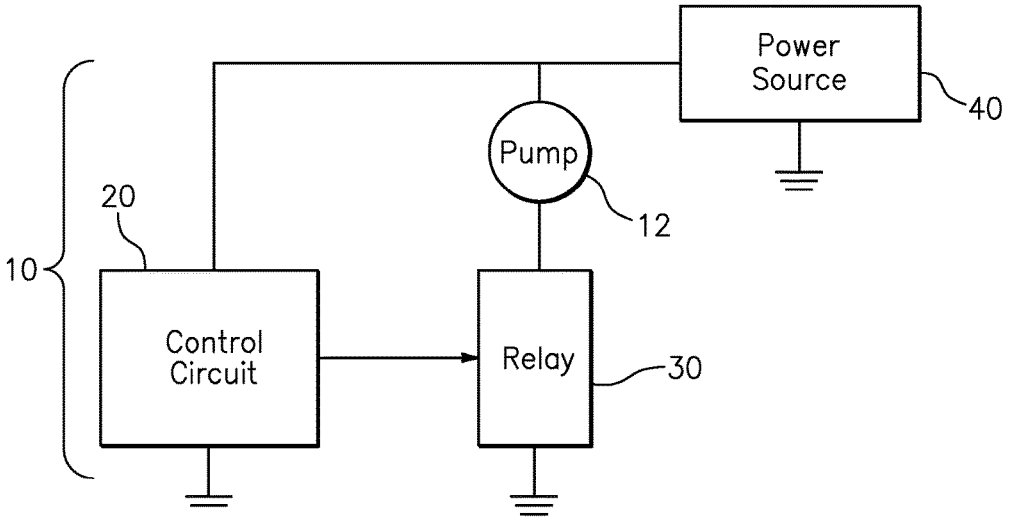
FIG. 7 is a block diagram of apparatus, including a pumping system having a combination of a pump and a control circuit, according to some embodiments of the present invention.

In the following description of the exemplary embodiment, reference is made to the accompanying drawing, which form a part hereof, and in which is shown by way of illustration of an embodiment in which the invention may be practiced. It is to be understood that other embodiments may be utilized, as structural and operational changes may be made without departing from the scope of the present invention.

DETAILED DESCRIPTION OF THE INVENTION

Details of the Present Invention

FIGS. 2-7 shows the present invention in the form of apparatus generally indicated as 10, including a pumping system, featuring a pump 12 and a control circuit 20 (see FIG. 7).

By way of example, FIG. 2 shows the pump 12 which may include an impeller housing 14 configured with at least one slit (aka "an anti air lock slit") at the top for trapped air to leave the impeller housing 14 once the pump 12 has been submerged. The pump 12 may take the form of a centrifugal pump, as well as other types or kinds of pumps either now known or later developed in the future. In FIG. 2, the slit may be configured substantially at the top of the impeller housing of the pump, although the scope of the invention is intended to include configuring the slit at other locations as long as trapped air can be released from inside the impeller housing 14. Moreover, the scope of the invention is not intended to be limited to any particular type, kind or configuration of the slit, or hole, as long as trapped air can leave or be released from the impeller housing once the pump has been submerged.

The control circuit 20 (see FIGS. 3 and 7) may be configured to cycle the pump 12 on and off for a predetermined number of cycles so that the trapped air will float to the top and be expelled out the slit when the pump 12 is cycled off. The cycling of the pump 12 on and off for a predetermined number of cycles at start-up is also known herein and referred to as either a stutter start anti-air lock start-up or system, and may also be referred to herein as an anti air-lock on/off start-up cycle. By way of example, the control circuit 20 (FIG. 7) may be arranged or configured inside or outside the pump 12 in FIG. 2, and the scope of the invention is not intended to be limited to the same.

FIG. 3

By way of example, FIG. 3 shows a graph having an ON/OFF cycle for the pump 12 each time it is started. Upon powering the pump 12, the motor(s) will turn on for some time, and then off for some time, and this process may be repeated for a predetermined number of cycles after which the motor will remain on until the pump 12 is manually powered off. The scope of the invention is not intended to be limited to any particular number of ON/OFF cycles or the duration of the ON/OFF cycles. Based on that disclosed herein, a person skilled in the art, without undue experimentation, would be able configured the control circuit 20 to cycle the pump 12 on and off for a predetermined number of cycles so that the trapped air will float to the top and be expelled out the slit when the pump 12 is cycled off.

FIG. 4: Air Locked Pump with Added Slit

FIG. 4 shows the pumping system 10 according to some embodiment of the present invention, e.g., before the implementation of the anti air-lock on/off start-up cycle. In FIG. 4, the pump 12 is shown immersed in a fluid, such as water, indicated by a dark coloration in FIG. 4. The pump 12 has an added slit that may allow the release of trapped air, but with the impeller constantly spinning the air into the water (and possibly cavitating) so as to form an air/water mixture as shown as by a light gray coloring in FIG. 4, the escape of the air is inefficient. Similar to that shown in FIG. 1, and consistent with that shown in FIG. 4, the pressure from the impeller(s) is overcome by the back pressure from the outlet hose, so there is no meaningful flow, if any, out the outlet hose. In effect, the pumping system is, or may be considered, merely an air locked pump with an added slit.

FIG. 5: Implementation of Anti Air-Lock On/Off Start-Up Cycle

In contrast to that in FIG. 4, FIG. 5 shows the pumping system 10 according to some embodiments of the present invention, e.g., when the pump 12 is turned off during the implementation of an anti air-lock on/off start-up cycle. In operation, when the motor is turned on, then turned off, the water (shown at the bottom of the impeller housing by a darker gray coloring) calms and the air (shown at the top of the impeller housing by a white coloring) is allowed to seep out of the anti air-lock slit. In effect, the turning on and shutting off of the pump allows the release of trapper air, which is shown as air bubbles floating to the top of the fluid in which the pump 12 is immersed.

FIG. 6: Pump Turned on After Anti Air-Lock On/Off Start-Up Cycle

FIG. 6 shows the pumping system 10 according to some embodiments of the present invention, e.g., when the pump is turned on after the implementation of the anti air-lock on/off start-up cycle, according to some embodiments of the present invention. When the pump turns back on, the housings are now full of water (as shown) and are able to overcome the back pressure of the hose allowing the flow of water. In contrast to that shown in FIG. 1, and consistent with that shown in FIG. 6, the pressure from the impellers overcomes the back pressure from the outlet hose, so there is water flow out and through the outlet hose. In effect, after releasing the air, the pump operates properly.

FIG. 7: Block Diagram of Pumping System

FIG. 7 shows the control circuit 20 that forms part of the pumping system generally indicated as 10 and that is arranged in relation to a power source 40. By way of example, the pumping system 10 may include a relay 30 coupled between the pump 12 and the control circuit 20, as shown. In operation, the control circuit 20 provides signaling to turn the relay 30 on/off in order to cycle the pump 12 on and off for the predetermined number of cycles so that the trapped air will float to the top and be expelled out the slit when the pump 12 is cycled off. By way of example, the relay 30 may be coupled directly to the motor of the pump 12, shown in FIGS. 4-6. Once the start-up process is complete, the control circuit 20 may be configured to leave the pump 12 on after the predetermined number of cycles.

Relays, and techniques for controlling and cycling such relays, are known in the art, and the scope of the invention is not intended to be limited to any particular type or kind thereof either now known or later developed in the future.

Embodiments are also envisioned in which the control circuit 20 is coupled directly to the motor of the pump 12 and to provide the signaling to turn the motor (see FIGS. 4-6) on/off in order to cycle the pump 12 on and off for the predetermined number of cycles so that the trapped air will float to the top and be expelled out the slit when the pump 12 is cycled off.

Implementation of the Functionality of the Control Circuit and Associated Signal Processor The control circuit 20 may be implemented in, or form part of, a signal processor module having a signal processor, and/or a printed circuit board (PCB), or some combination thereof.

Printed circuit boards (PCBs) are known in the art, and the scope of the invention is not intended to be limited to any particular type or kind thereof either now known or later developed in the future for implementing the runtime on/off cycling functionality of the present invention.

By way of example, the functionality of the control circuit 20, the PCB, the associated signal processor, and/or any associated signal processing may be implemented using hardware, software, firmware, or a combination thereof, although the scope of the invention is not intended to be limited to any particular embodiment thereof. For example, in a typical software implementation, the signal processor may take the form of one or more microprocessor-based architectures having a processor or microprocessor, a random and/or read only access memory (RAM/ROM), where the RAM/ROM together forming at least part of the memory, input/output devices and control, data and address buses connecting the same. A person skilled in the art would be able to program such a microprocessor-based implementation with computer program code to perform the functionality described herein without undue experimentation. The scope of the invention is not intended to be limited to any particular implementation using technology either now known or later developed in the future. Moreover, the scope of the invention is intended to include the signal processor being a stand alone module, or in some combination with other circuitry for implementing another module. Moreover still, the scope of the invention is not intended to be limited to any particular type or kind of signal processor used to perform the signal processing functionality, or the manner in which the computer program code is programmed or implemented in order to make the signal processor operate. A person skilled in the art without undue experimentation would appreciate and understand how to develop or write a suitable software program or algorithm for running on, e.g., such a PCB-based control circuit, so as to implement the functionality set forth herein.

Such a PCB-based control circuit and/or the associated signal processor may include one or more other sub-modules for implementing other functionality that is known in the art, but does not form part of the underlying invention per se, and is not described in detail herein.

Centrifugal Pump

In one particular embodiment, the present invention may take the form of, or may be implemented in, a centrifugal pump encased in such a housing that directs the water projected from the pump's impeller into an exit tube. In the centrifugal pump, there exists, or may be configured, a small hole or slit formed in this casing or housing through which to expel the trapped air when the pump is submerged. The centrifugal pump and/or pumping system may include the control circuit like element 20 whose function is to cycle, e.g., the motor of the centrifugal pump on and off for some predetermined time upon powering of the unit or pumping system, consistent with that set forth herein.

The Pump 12

The pump 12, like that shown in FIGS. 2 and 4-7, may also include, e.g., other parts, elements, components, or circuits that do not form part of the underlying invention, including inlet ports, outlet ports, pressure transducers, wiring for coupling the motor to the control circuit 20, and are thus not identified and described in detail herein.

Moreover, pumps having motors and impeller arranged or configured thereon are known in the art, and the scope of the invention is not intended to be limited to any particular type or kind thereof either now known or later developed in the future.

Possible Applications

Possible applications are envisioned to include any type or kind of pump or rotary equipment that may be submerged and contain trapped air, e.g., in its housing or impeller housing, including but not limited to centrifugal pumps or other types or kinds of submersible pumps either now known or later developed in the future.

SCOPE OF THE INVENTION

Although described in the context of particular embodiments, it will be apparent to those skilled in the art that a number of modifications and various changes to these teachings may occur. Thus, while the invention has been particularly shown and described with respect to one or more preferred embodiments thereof, it will be understood by those skilled in the art that certain modifications or changes, in form and shape, may be made therein without departing from the scope and spirit of the invention as set forth above.

We claim:

1. A stutter start anti-air lock system comprising:

a pump having an impeller housing configured with a slit at the top for trapped air to leave the pump once the pump has been submerged in a liquid and the impeller housing contains an air/liquid mixture; and a control circuit configured to initiate a start-up process upon powering the pump to provide signaling to implement an anti air-lock on/off start-up cycle to cycle the pump on and off for a predetermined number of cycles, wherein trapped air not previously expelled once the pump has been submerged will float to the top and be expelled out the slit when the pump is cycled off, the control circuit also configured, once the start-up process is complete, to leave the pump on after the predetermined number of cycles until the pump is powered off, wherein the pump is configured with a motor coupled to an impeller via a shaft; and wherein a discharge from the impeller housing is a tangential discharge, the tangential discharge extending away from the impeller housing below a central axis of the shaft.

2. The stutter start anti-air lock system according to claim 1, wherein the stutter start anti-air lock system comprises a relay arranged between the pump and the control circuit, the relay configured to respond to the signaling provided from the control circuit and provide relay signaling to cycle the pump on and off for the predetermined number of cycles.

3. The stutter start anti-air lock system according to claim 1, wherein the stutter start anti-air lock system is configured as a pumping system having a combination of the pump and the control circuit.

4. The stutter start anti-air lock system according to claim 1, wherein the pump is configured to contain the control circuit, so as to have the control circuit arranged therein.

5. The stutter start anti-air lock system according to claim 1, wherein the pump is configured as a centrifugal pump.

6. The stutter start anti-air lock system according to claim 1, wherein the slit is configured at the highest point of the impeller housing; and the control circuit is configured for implementing the anti air-lock on/off start-up cycle to cycle the pump on for some time and off for some corresponding time for the predetermined number of cycles, and also configured to turn on the pump after implementation of the anti air-lock on/off start-up cycle.

7. The stutter start anti-air lock system according to claim 1, wherein the control circuit is configured at start-up to repeatedly turn the pump:

on to fill the impeller housing with liquid after some trapped air in the air/liquid mixture is expelled out of the slit, and off to allow further trapped air in the air/liquid mixture to float to the top of the impeller housing and be expelled out of the slit for each one of the predetermined number of cycles.

8. The stutter start anti-air lock system according to claim 1, wherein each one of the predetermined number of cycles to cycle the pump on and off comprises powering the motor on and powering the motor off.

9. The stutter start anti-air lock system according to claim 8, wherein the control circuit is configured to provide signaling to turn the motor on and off in order to cycle the pump on and off.

10. The stutter start anti-air lock system according to claim 1, wherein the pump further comprises an outlet hose configured to allow the flow of water out of the pump when a pressure from the impeller overcomes a back pressure from the outlet hose.

11. The stutter start anti-air lock system according to claim 1, wherein upon each time the pump is started, the control circuit is configured to cycle the pump on and off for the predetermined number of cycles and to leave the pump on after the predetermined number of cycles until the pump is manually powered off.

12. The stutter start anti-air lock system according to claim 1, wherein the control circuit is arranged outside the pump.

13. The stutter start anti-air lock system according to claim 1, wherein cycling the pump off during the anti air-lock on/off start-up cycle causes the liquid in the air/liquid mixture in the impeller housing to calm and allows the air of the air/liquid mixture in the impeller housing to seep out the slit.

14. The stutter start anti-air lock system according to claim 1, wherein the slit is arranged on an outer wall of the pump and is configured to expel trapped air from the impeller housing to the liquid in which the pump is submerged.

* * * * *